United States Patent [19]

Somerville

[11] Patent Number: 4,828,268

[45] Date of Patent: May 9, 1989

[54] GAME BOARD

[76] Inventor: Norman H. Somerville, 1840 Detroit St., Dearborn, Mich. 48124

[21] Appl. No.: 270,597

[22] Filed: Jun. 4, 1981

[51] Int. Cl.[4] ..... A63F 3/00

[52] U.S. Cl. ..... 273/283; 273/284

[58] Field of Search ..... 273/157, 294, 249, 262, 273/283, 284; 46/30

[56] References Cited

U.S. PATENT DOCUMENTS

| | | | |
|---|---|---|---|
| 1,165,688 | 12/1915 | Maris | 273/262 |
| 1,224,173 | 5/1917 | Kajiyama | 273/249 |
| 2,122,577 | 7/1938 | Mattes et al. | 46/30 X |
| 2,703,713 | 3/1955 | Moyer | 273/262 |
| 3,048,404 | 8/1962 | Tebbs | 273/262 |
| 3,057,624 | 10/1962 | Bassett | 273/283 |
| 3,206,887 | 11/1965 | Eyler et al. | 273/283 |
| 3,212,201 | 10/1965 | Jensen | 273/157 R X |
| 3,432,961 | 3/1969 | Goldfarb | 273/157 R |
| 3,508,753 | 4/1970 | Mackey | 273/237 |
| 3,520,537 | 7/1970 | Peebles | 273/260 |
| 3,558,136 | 1/1971 | McFarland | 273/157 R X |
| 3,623,261 | 11/1971 | Freese | 46/30 |
| 3,692,310 | 9/1972 | Martin | 273/284 X |
| 3,695,615 | 10/1972 | Shoptaugh | 273/157 R |
| 3,773,327 | 11/1973 | Kremer | 273/294 |
| 4,021,939 | 5/1977 | May | 434/403 |
| 4,244,580 | 1/1981 | Hoyles | 273/272 |

FOREIGN PATENT DOCUMENTS

| | | | |
|---|---|---|---|
| 637544 | 1/1962 | Canada | 273/294 |
| 1145973 | 3/1963 | Fed. Rep. of Germany | 46/30 |
| 26707 | of 1913 | United Kingdom | 46/30 |

*Primary Examiner*—Richard C. Pinkham
*Assistant Examiner*—Benjamin Layno
*Attorney, Agent, or Firm*—Gifford, Groh, Sheridan, Sprinkle and Dolgorukov

[57] ABSTRACT

A game board is provided for use with a strategy game of the type in which at least two opposing players move diverse playing pieces over the game board in simulated combat. The game board comprises a plurality of planar board pieces each of which are substantially identical to each other in shape and size. In addition, indicia is formed on one face of the game board pieces which is representative of a land terrain condition. To form the game board, the board pieces are placed closely adjacent to each other so that the indicia on the game board pieces are visible from the top of the game board.

4 Claims, 1 Drawing Sheet

GAME BOARD

BACKGROUND OF THE INVENTION

I. Field of the Invention

The present invention relates generally to game boards and, more particularly, to a game board for use in a strategy game of simulated combat.

II. Description of the Prior Art

There are a number of previously known strategy games for simulated combat. These previously known strategy games generally comprise a game board on which a map is depicted. Furthermore, the map includes a plurality of different land terrain conditions such as mountains, rough terrain, railroads, cities,and the like.

These previously known strategy game boards further include a grid superimposed upon the game board map so that each position in the grid defines a playing position for one of the players. Typically, the grid playing positions are hexagonal in shape although other shapes are also used.

During the play of the game, at least two opposing players move diverse playing pieces over the game board in simulated combat with each other. These playing pieces can be representative of troops, military equipment and the like. Moreover, the actual movement of these playing pieces across the game board as well as the scoring of the game is dependent upon the land terrain conditions at and adjacent the game board grid on which a playing piece is positioned. For example, the rules of the game may require slower troop movement over mountain terrain than is permissible over flat terrain.

One disadvantage of the previously known strategy games, however, is that the game board with its map and superimposed grid is fixed and, therefore, nonvariable. Consequently, after repeated play of the game, the novelty and excitement of the game diminishes. At that time, it is necessary to purchase another strategy game with a different game board and different map in order to obtain the desired excitement and renewed novelty of the game. The frequent purchase of different strategy games, however, is very expensive and limited to the availability of different strategy games.

SUMMARY OF THE PRESENT INVENTION

The present invention overcomes the above mentioned disadvantages of the previously known simulated combat board games by providing a game board in which the land terrain can be varied.

In brief, the game board according to the present invention comprises a plurality of planar game board pieces each of which are substantially identical to each other in shape and size. Indicia is formed on at least one face of the game board pieces which is representative of a game condition, such as a land terrain condition, e.g., mountains, railroads, cities, rough terrain, and the like.

The game board pieces are preferably hexagonal in shape so that the game board pieces can be positioned on a flat surface and so that each edge of each game board piece abuts against an edge on an adjacent game board piece thus forming the game board. Since the pieces are interchangeable, the game condition indicia on the resulting game board can be varied in any fashion desired.

In a modified form of the game board of the present invention, the game board pieces include means for locking adjacent game board pieces together. In the preferred form of the invention, this locking means is a plurality of outwardly extending locking tabs and inwardly extending locking recesses formed on each game piece. The outwardly extending tabs are adapted to be lockingly received within the locking recesses on adjacent game board pieces and vice versa. The means for locking the game board pieces together thus adds stability to the game board once constructed.

Since the game board pieces are interchangeable with each other, the overall game board can be constructed with virtually an infinite number of different combinations of game conditions. Consequently, many different variations of a single game can be played while using the game board according to the present invention.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
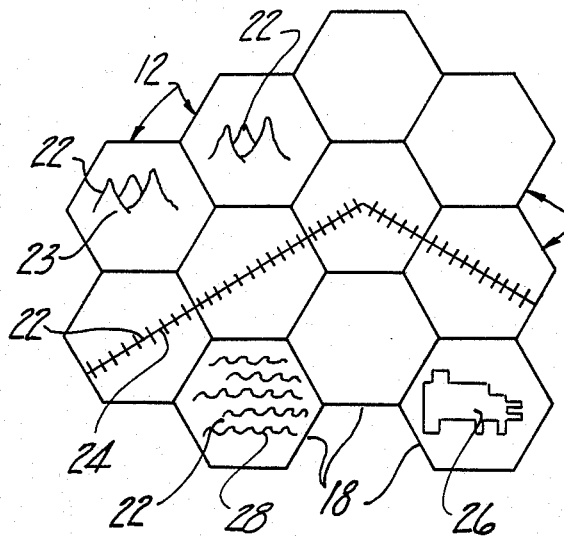
FIG. 1 is a fragmentary plan view illustrating a first preferred embodiment of a game board according to the present invention.
Figure 2:
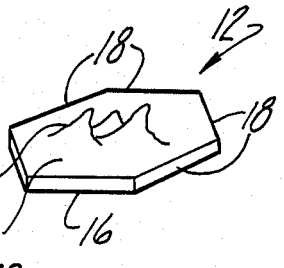
FIG. 2 is a perspective view illustrating one game board piece of the game board illustrated in FIG. 1.

With reference first to FIGS. 1 and 2, a first preferred embodiment of the game board according to the present invention is thereshown. As will become shortly apparent, the game board according to the present invention is for use during the play of a game where at least one player moves a game piece across the game board, e.g., a strategy game.

The game board shown in FIGS. 1 and 2 is constructed from a plurality of game board pieces 12 which are planar and substantially identical to each other in shape and size. The game board pieces 12 shown in FIGS. 1 and 2 are a regular hexagon in shape thus having an upper surface 14, a lower surface 16 and 6 equal length sides 18.

In order to form the game board, the lower surface 16 of the game board pieces 12 are positioned on a flat supporting surface 20 so that at least one edge 18 of each game board piece 12 is aligned with and abuts against the edge 18 of an adjacent game board piece 12 thus forming a game board which is honeycomb in appearance. Furthermore, since the game board pieces 12 shown in FIGS. 1 and 2 have the shape of a regular hexagon, each game board piece 12 abuts against 6 adjacent game board pieces, i.e., one game board piece 12 along each of its sides 18 except, of course, for the game board pieces 12 which are positioned along the outer periphery of the game board.

Still referring to FIGS. 1 and 2, at least some of the game board pieces 12 include indicia 22 formed on their upper surface 14 which is indicative of a particular game condition, such as a land terrain condition. For example, one game board piece 12 can include indicia 23 representative of mountain terrain while different indicia 24 can be used to indicate a railroad track. Still further indicia 26 can be used to indicate the presence of a city while indicia 28 is used to indicate a rough terrain and so on. It will be understood, of course, that the precise indicia used to indicate a particular game condition is unimportant but, instead, it is only important that different indicia are used to indicate different game conditions.

In order to form the game board of the present invention, the game board pieces 12 are positioned on the support surface 20 so that the edges 18 of adjacent game board pieces abut against each other as previously described. Since the game board pieces 12 are substantially identical to each other in shape and size, they may be interchanged with each other in order to form different game or land terrain conditions as desired. Consequently, a large number of game boards can be constructed with different game or land terrain conditions from the same game board pieces 12.

Figure 3:
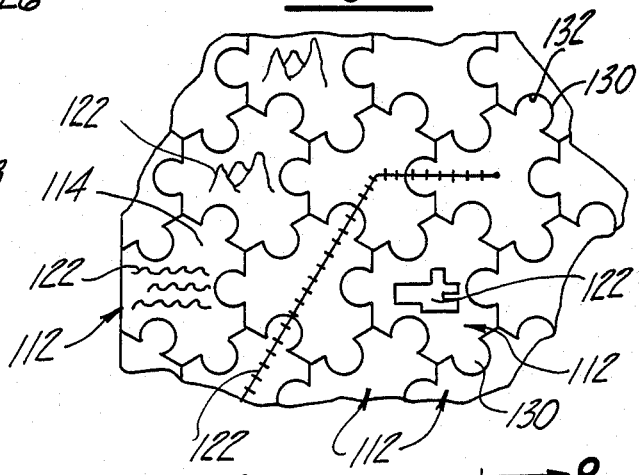
FIG. 3 is a fragmentary plan view illustrating a second preferred form of the game board according to the present invention.
Figure 4:
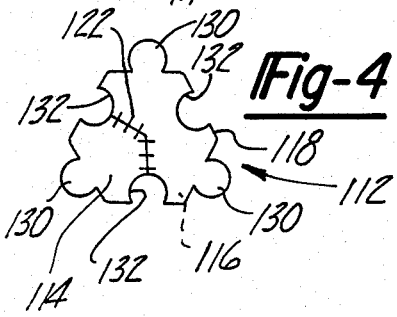
FIG. 4 is a perspective view of a game board piece of the game board shown in FIG. 3.

With reference now to FIGS. 3 and 4, a second preferred embodiment of the game board according to the present invention is thereshown and comprises a plurality of planar game board pieces 112 which are substantially identical to each other in shape and size. Each game board piece 112 has an upper planar surface 114, a lower surface 116 and indicia 122 formed on its upper surface 114 indicative of a game condition. As before, different indicia 122 are used to simulate different types of game or land terrain conditions.

Still referring to FIGS. 3 and 4, each game piece 112, as before, has six sides 118. Unlike the game board 12 shown in FIGS. 1 and 2, however, a semicircular locking tab 130 protrudes outwardly from every other side 118 of the game board piece 112 while, similarly, an inwardly extending semicircular locking recess 132 is formed on the other sides 118 of the game board piece 112. The locking tabs 130 correspond in shape to the locking recesses 132 and both the tabs 130 and recesses 132 are centered on their respective sides 118 of the game board piece 112. Consequently, each locking tab 130 is adapted to lockingly engage a recess 132 on an adjacent game board piece 112 while, similarly, each locking recess 132 is adapted to lockingly receive the tab 130 from an adjacent game board piece 112 thus forming the game board as is best shown in FIG. 3. Thus, the constructed game board in FIG. 3 is in the form of a jigsaw puzzle having identically shaped pieces. The provision of the locking tabs 130 and locking recesses 132 enhances the rigidity of the game board once constructed and prevents the game board from being accidentally disrupted after the start of play of the game.

Figure 10:
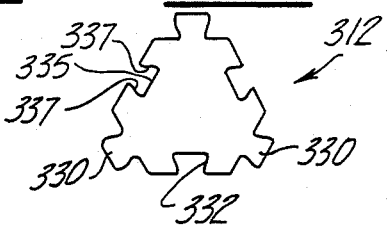
FIG. 10 is a view similar to FIG. 4 but showing a modification thereof.

With reference to FIG. 10, a game board piece 312 is thereshown which is similar to the game board pieces 112 shown in FIGS. 3 and 4. As such, the game board piece 312 is generally planar and has three outwardly extending locking tabs 330 and an inwardly extending locking recess 332 positioned in between each pair of locking tabs 330. The locking tabs 330 and recesses 332, however, are not semicircular in shape but rather have a generally straight edge 335 and inwardly tapered sides 337. In order to form the game board, the game board pieces 330 are interlocked together by inserting the locking tabs 330 into the locking recesses 332 on adjacent pieces 312 and vice versa.

With reference now to FIGS. 5–8, a still further preferred embodiment of the present invention is thereshown. Unlike the two previously described embodiments of the game board of the present invention, in the embodiment shown in FIGS. 5–8 each game board piece 212 is constructed from a lower substrate 240 and upper member 242. Both the substrate 240 and upper member 242 are planar and the upper member 242 is flatly secured on top of the substrate 240 and secured in place in any conventional fashion, such as by glue. As before, each game board piece 212 is substantially identical to each other in both shape and size.

Figure 7:
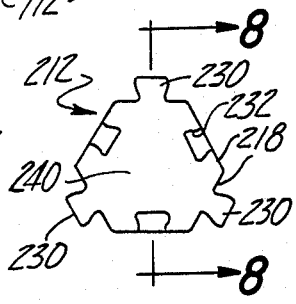
FIG. 7 is a bottom plan view thereof.

As is best shown in FIG. 7, the lower substrate 240 is substantially identical to the game board piece 112 shown in FIG. 4 and, as such, includes six sides 218 which are substantially identical to each other in length. A locking tab 230 extends outwardly from every other side 218 of the substrate 240 while an inwardly extending locking recess 232 is formed on each of the remaining sides of the substrate 240. As before, the locking tabs 230 and recesses 232 have the same shape and, in use, serve to lock the substrate 240 of one game board piece 212 to the substrates 240 on the adjacent six game board pieces.

Figure 6:
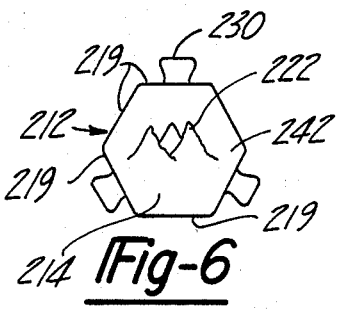
FIG. 6 is a top plan view illustrating a game board piece of the game board shown in FIG. 5.
Figure 5:
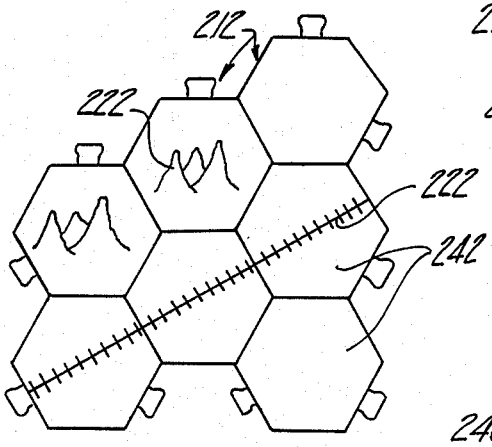
FIG. 5 is a fragmentary plan view illustrating still a further preferred embodiment of the game board according to the present invention.

With reference now particularly to FIGS. 5 and 6, the upper member 242 is substantially the same in shape as the game board piece 12 illustrated in FIG. 2 and thus is in the form of a regular hexagon having six sides 219 which are the same in length as the sides 218 on the substrate 240. The upper member 242 is secured to the substrate 240 so that its sides 219 register with and are aligned with the sides 218 on the substrate 240. As before, indicia 222 is formed on the upper surface 214 of the member 242 which is indicative of a game or land terrain condition.

With reference now particularly to FIG. 5, in constructing the game board according to the present invention, the substrates 240 on the game board pieces 212 are interlocked together which adds rigidity to the game board when constructed. Simultaneously, the edges 219 on the hexagonal upper members 242 abut against the edges 219 of six adjacent game board pieces 212 thus giving the outer appearance of a honeycomb structure such as shown in FIG. 1. Consequently, the embodiment of the invention illustrated in FIGS. 5–8, although more complex in construction than the two previously described embodiments of the invention, is advantageous in that the pieces are desirably interlocked together and also provide the desired honeycomb appearance for the game board once constructed.

Figure 9:
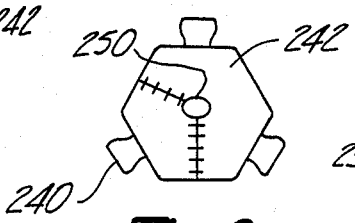
FIG. 9 is a top plan view similar to FIG. 6 but showing still a further modification thereof.
Figure 8:
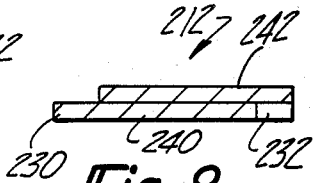
FIG. 8 is a cross sectional view taken substantially along line 8—8 in FIG. 7.

With reference now to FIG. 9, a modification to the embodiment of the invention illustrated in FIG. 5–8 is thereshown. In the modified form of the invention, the upper planar member 242 is secured to the substrate 240 by a central pivot pin 250 so that the upper member 242 can rotate with respect to the substrate 240. This provision thus enables the upper member 242 to be rotated to any one of six rotational positions with respect to the substrate 240 to thereby obtain still further variations of the game board.

From the foregoing, it can be seen that the present invention provides a unique game board for use with a game having positions indicative of different game conditions. The present invention is advantageous in that the game board can be constructed with an almost infinite number of variations of game or land terrain conditions. When the game board is constructed with a different variation of the game condition, essentially an entirely new and different game can be played on the board without the necessity of purchasing an entirely new game board for the game.

Having described my invention, however, many modifications thereto will become apparent to those skilled in the art to which it pertains without deviation from the spirit of the invention as defined by the scope of the appended claims.

I claim:

1. A game board having a plurality of playing positions, said game board comprising:

a plurality of planar game board pieces, said board pieces being substantially identical to each other in shape and size, indicia formed on at least one face of each board piece, said indicia being representative of a game condition, wherein each board piece comprises a planar substrate and a planar upper member having one face rotatably mounted to one face of said substrate, said substrate including means for locking said substrate to the substrate of at least one adjacent board piece, wherein said indicia is formed on the other face of the upper member, and wherein said board pieces are placed closely adjacent to each other to form the game board.

2. The invention as defined in claim 1 wherein said locking means comprises at least one outwardly extending locking tab and a like number of inwardly extending locking recesses formed on the substrate of each board piece, each locking tab adapted to engage a locking recesses on the substrate of an adjacent board piece and each locking recess adapted to receive a locking tab from the substrate of an adjacent board piece.

3. The invention as defined in claim 2 wherein said locking means further comprises at least three locking tabs and at least three locking recesses on the substrate of each board piece, said locking tabs and locking recesses alternating and being equidistantly spaced around each substrate of each board piece.

4. A game board having a plurality of playing positions, said game board comprising:

a plurality of planar game board pieces, said board pieces being substantially identical to each other in shape and size, indicia formed on at least one face of each board piece, said indicia being representative of a game condition, wherein each board piece comprises a planar substrate and a regular hexagonal upper member having six straight edges of equal length circumferentially joined together and having one face mounted to one face of said substrate, said substrate including means for locking said substrate to the substrate of at least one adjacent board piece whereby the entire length of at least one of said straight edges of said upper member engages the entire length of the edge of the upper member of an adjacent board piece, wherein said locking means comprises a plurality of locking tabs extending outwardly perpendicular to said straight edges of said upper member, and like shaped inwardly extending locking recesses, each locking recess adapted to engage a locking tab on the substrate of an adjacent board piece, said locking tags and locking recesses alternating around said substrate, wherein said indicia is formed on the other face of the upper member, wherein said board pieces are placed closely adjacent to each other to form the game board, wherein said game board is assembled from said game board pieces prior to the start of play of a game, and wherein the upper member is rotatably mounted to said substrate.

* * * * *